US005500659A

United States Patent [19]

Curran, Jr. et al.

[11] Patent Number: 5,500,659

[45] Date of Patent: Mar. 19, 1996

[54] METHOD AND APPARATUS FOR CLEANING A PRINTHEAD MAINTENANCE STATION OF AN INK JET PRINTER

[75] Inventors: Donald P. Curran, Jr.; Lonnie J. Pollocks, Jr., both of Rochester; David P. Breemes, Sr., Palmyra; Leonard M. Carreira, Penfield; Thomas J. Trenchard, Macedon, all of N.Y.

[73] Assignee: Xerox Corporation, Stamford, Conn.

[21] Appl. No.: 152,626

[22] Filed: Nov. 15, 1993

[51] Int. Cl.[6] ..... B41J 2/165

[52] U.S. Cl. ..... 347/28; 347/30; 347/31; 347/87; 347/98

[58] Field of Search ..... 347/22, 28, 35, 347/29, 30, 32, 87, 93, 36, 31, 98, 100

[56] References Cited

U.S. PATENT DOCUMENTS

| | | | |
|---|---|---|---|
| 4,256,610 | 3/1981 | Hwang | 347/28 |
| 4,463,359 | 7/1984 | Ayata et al. | 347/56 |
| 4,479,136 | 10/1984 | Lewis et al. | 347/33 |
| 4,485,028 | 11/1984 | King | 252/99 |
| 4,746,938 | 5/1988 | Yamamori et al. | 347/28 |
| 4,853,717 | 8/1989 | Harmon | 29/347 |
| 4,987,429 | 1/1991 | Finley et al. | 347/28 X |
| 5,130,723 | 7/1992 | Yamamoto et al. | 347/100 |
| 5,257,044 | 10/1993 | Carlotta et al. | 347/32 |
| 5,289,212 | 2/1994 | Carlotta | 347/87 |
| 5,300,958 | 4/1994 | Burke et al. | 347/28 |

FOREIGN PATENT DOCUMENTS

| | | | |
|---|---|---|---|
| 60-190362 | 9/1985 | Japan | 347/28 |
| 5-185599 | 7/1993 | Japan | 347/22 |

*Primary Examiner*—John E. Barlow, Jr.
*Attorney, Agent, or Firm*—Tallam I. Nguti

[57] ABSTRACT

A cleaning apparatus for removing accumulated waste ink from a service or maintenance station of an ink jet printer includes a housing that defines a fluid storage chamber, and at least one output aperture that is formed in a wall of the housing, and communicates with the storage chamber. The cleaning apparatus further includes a cleaning liquid that is stored in the fluid storage chamber for ejecting through the at least one output aperture. The cleaning liquid advantageously includes ink dissolving compositions for dissolving thickened or dried ink waste and other contaminants that have undesirably accumulated in portions of the service or maintenance station. The method of cleaning the service or maintenance station of an ink jet printer includes (a) temporarily infusing waste ink and contamination-collecting portions of the service or maintenance station with a cleaning liquid that includes ink dissolving compositions, and (b) then purging or flushing out such cleaning liquid from the service or maintenance station.

16 Claims, 7 Drawing Sheets

METHOD AND APPARATUS FOR CLEANING A PRINTHEAD MAINTENANCE STATION OF AN INK JET PRINTER

FIELD OF THE INVENTION

The present invention relates to drop-on-demand ink jet printing, and more particularly to a method and apparatus for cleaning a service or maintenance station of a drop-on-demand ink jet printer.

BACKGROUND OF THE INVENTION

Generally, a drop-on-demand ink jet printing device or printer includes a printhead, usually in the form of a cartridge, that has ink-filled channels and an ink ejecting nozzle associated with each channel. The printhead as such also includes a series of selectively actuatable electromechanical or electro-thermal transducers for producing a vapor bubble on demand in each ink-filled channel. Selected actuation of each transducer produces a vapor bubble and causes the bubble to expand in the channel of selection, thereby causing ink in the channel to accelerate towards, and until it bulges through, the associated nozzle. De-actuation of the transducer causes the vapor bubble to collapse resulting in a volumetric contraction of ink, near the nozzle, back into the channel. Because of such contraction, the bulging ink is separated as a droplet from the contracting ink in the channel. Ordinarily, the acceleration of the ink towards and through the nozzle, while a formed vapor bubble is expanding, is sufficient to provide the momentum and velocity that is needed to move the separated ink droplet away from the nozzle in a substantially straight line direction towards a recording medium, such as paper, that is located proximate the nozzle.

In existing thermal ink jet printing devices, that is in ink jet printing devices of the electro-thermal transducer type, the printhead cartridge, for example, comprises one or more ink filled channels, such as disclosed in U.S. Pat. No. 4,463,359. Each channel communicates with an ink supply chamber, or ink manifold, at one end, and has a nozzle opening at the opposite end thereof. Typically, the printhead has a linear or matrix array of such channels and nozzles, and is formed as a prepackaged, usually disposable print cartridge that includes a sealed container for holding a supply of ink. Generally, the print cartridge may include an electronic control interface unit to interface with the electronic controller of the printer, as well as with electronic parts that are associated with the ink channels in the printhead. The electronic parts for example may include resistive heaters and any electronic temperature sensors, as well as digital means for converting incoming signals from the electronic controller of the printer for imagewise operation of the heaters.

In one common design of printer, for example, the print cartridge is mounted on a movable carriage with the printhead thereof against a sheet on which an image is to be printed. During printing periods, the print cartridge is moved periodically along with the carriage, across the sheet, in repeatable swaths, in order to form an image, much like a typewriter. During non-printing periods, the print cartridge is at rest and parked, awaiting printing instructions.

In another common design of printer, however, the print cartridge has a full-width linear array of channels and nozzles that span the full width of the printing zone of the recording medium or sheet. In this type of printer, the print cartridge is stationary, and the recording medium or sheet is moved transversely past the full-width linear array of channels and nozzles.

Typically, printhead cartridges are purchased on an as needed basis by the consumer, and are used either until the supply of ink is exhausted, or until the print quality produced thereby becomes unacceptable. As it is well known, the print quality of a printhead cartridge can become unacceptable in part because of the deleterious build up, particularly in the nozzles, of plugs of dried ink, as well as of other contaminants such as paper dust. As a consequence, various methods and apparatus as disclosed for example in the following patents, have been proposed for use in such ink jet printers to prevent such build ups.

In U.S. Pat. No. 4,746,938, for example, an anti-clogging and printhead washing system is disclosed for use in preventing residual or waste ink, that has adhered to the nozzles, from drying out and clogging printhead nozzles. The disclosed system includes a printhead capping device and a water washing component for removing such ink from the printhead.

In U.S. Pat. No. 4,853,717, a service station is disclosed for maintaining the printhead in good working condition over its intended life. The disclosed service station includes a capping member for covering the nozzles when the printhead is not in use, a wiping means for removing ink and contaminants from a nozzle face of the printhead, and means including a vacuum pump for priming the printhead and thus clearing or opening any clogged nozzles thereof.

In commonly assigned U.S. application Ser. No. 07/974,362 filed Nov. 12, 1992 and incorporated herein by reference, a similar service or maintenance station is disclosed for maintaining a printhead in an ink jet printer. The disclosed station includes a pair of wiper blades for removing residual or waste ink and contaminants from a nozzle face of the printhead, a capping member for sealing around such nozzles, absorbent material in the capping member for receiving the waste ink and contaminants removed from the nozzles, and vacuum means for applying a predetermined level of vacuum pressure to the printhead in order to clear any clogged nozzles, as well as to effectively prime the printhead.

Unfortunately, however, as recognized in above-cited U.S. Pat. No. 4,746,938, such a service or maintenance station can itself become soiled and dirty, over time, from an accumulation of dried ink plugs and other waste that have been removed, as above, from the printhead. As a consequence, the cleaning effectiveness of the service or maintenance station, of course, becomes gradually impaired and critical levels of vacuum pressure required for effective unclogging and priming of the printhead, may become unattainable. The end result normally is poor print quality, which may be incorrectly diagnosed and serviced expensively as a printhead failure problem.

The likelihood and degree of a service or maintenance station becoming impaired as such depends unpredictably, for example, on the type of ink used, the type and quality of paper used, and on the history of printing and non-printing periods of the printhead. In order to insure the reliability and the cleaning effectiveness of the service or maintenance station over its intended life in spite of such unpredictability, there is therefore a need for a method and apparatus for periodically cleaning, that is, dissolving and purging or flushing out accumulated waste ink and other contaminants from such a service or maintenance station.

SUMMARY OF THE INVENTION

In accordance with the present invention, a cleaning method and apparatus are provided for removing accumulated waste ink and other contaminants from a service or maintenance station for a printhead of an ink jet printer. According to one aspect of the invention, the cleaning apparatus includes a housing that defines a fluid storage chamber, and at least one output aperture that is formed in a wall of the housing, and that communicates with the storage chamber. The cleaning apparatus further includes a cleaning liquid that is stored in the fluid storage chamber for ejecting through the at least one output aperture. The cleaning liquid advantageously includes ink-dissolving compositions for dissolving thickened or dried ink waste and other contaminants that have undesirably accumulated in the service or maintenance station of the ink jet printer.

According to another aspect of the present invention, the method of cleaning the service or maintenance station of an ink jet printer includes (a) mounting into the ink jet printer a cartridge cleaning apparatus having an output aperture and containing a cleaning liquid that includes ink dissolving compositions; (b) temporarily capping over the output aperture and applying vacuum pressure to the cleaning apparatus to suck out cleaning liquid therefrom; (c) infusing portions of the service or maintenance station which collect waste ink and other contamination with the sucked-out cleaning liquid; and (b) then purging or flushing out from the service or maintenance station dissolved ink and contaminants in such cleaning liquid.

BRIEF DESCRIPTION OF THE DRAWINGS

While the present invention will hereinafter be described in connection with preferred embodiments thereof, it will be understood that it is not intended to limit the invention to that embodiment. On the contrary, it is intended to cover all alternatives, modifications, and equivalents thereof as may be included within the spirit and scope of the invention as defined by the appended claims.

DETAILED DESCRIPTION OF THE INVENTION

Figure 1:
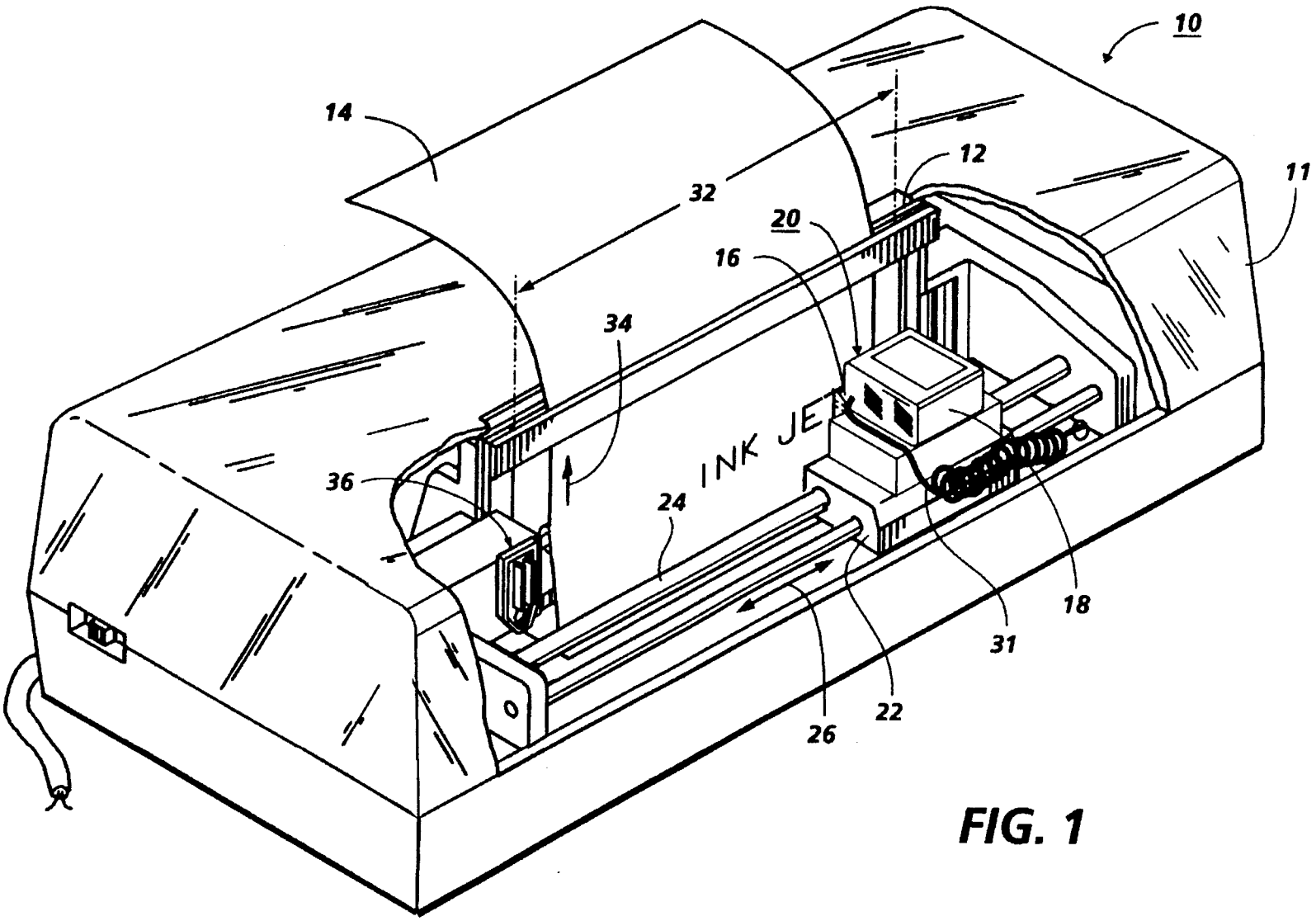
FIG. 1 is an isometric view of a thermal ink jet printer including a movable ink-supplied printhead and a printhead maintenance station.

Referring now to FIG. 1, an ink jet printer is shown generally as 10, and includes a frame 11, means 12 for supporting a recording medium 14 (such as a sheet of paper), and a printhead 16 that is attached to an ink supply unit 18. The printhead 16 and ink supply 18 are formed as a single print cartridge 20 that is removably mounted on a carriage 22, for translation back and forth on guide rails 24 as indicated by arrow 26. As mounted, the printhead 16 and ink supply unit 18 move concurrently with carriage 22. Note also that instead of a moving printhead, the printer 10 could alternatively have a fixed position full-page width printhead that has an array of nozzles that span the full width of a printing zone.

Figure 2:
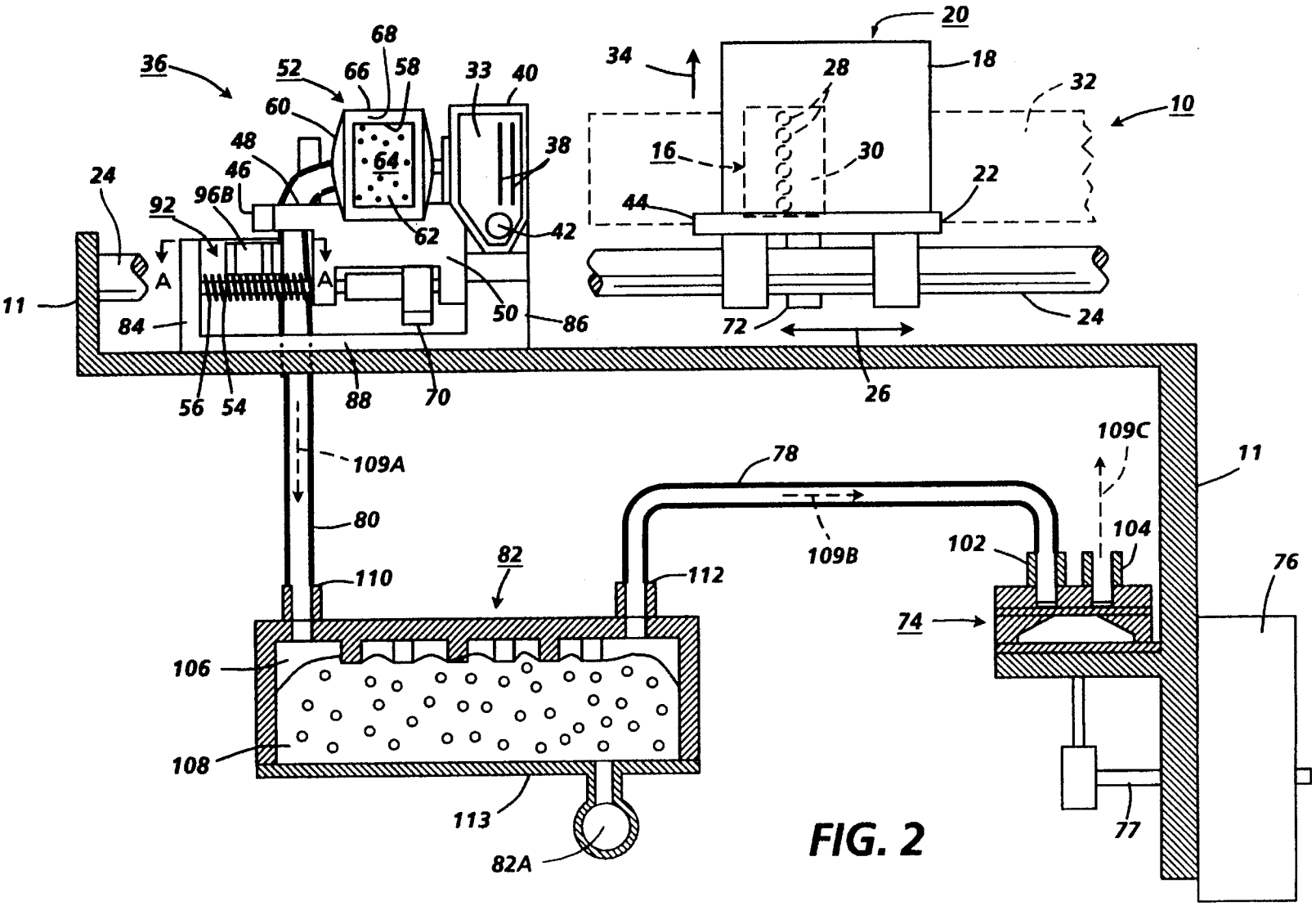
FIG. 2 is a schematic front elevational view of the maintenance station of FIG. 1.

Referring now to FIG. 2, the printhead 16 contains a plurality of ink channels (not shown) which terminate in nozzles 28 that are formed in a nozzle face 30 (both shown in dashed lines) of the printhead. Each channel functions to carry ink from the ink supply unit 18 to its respective ink ejecting nozzle 28. The printer 10 as powered can be run in a printing mode or in a service and priming mode. When the printer 10 is in the printing mode, the cartridge 20 and carriage 22 as powered through means 31, translate or reciprocate back and forth across, and parallel to, a printing zone 32 that is less than or equal to the in-track dimension of the recording medium 14. During such translation, ink droplets (not shown) are ejected on demand from selected nozzles 28 for projection onto the recording medium 14, in order to print information thereon one swath at a time. During each such pass or translation in one direction of the carriage 22, the recording medium 14 is stationary, but at the end of each pass, the recording medium is stepped in the direction of arrow 34 for the distance of the height of one printed swath. For a more detailed explanation of the printhead and printing thereby, refer to U.S. Pat. Nos. 4,571,599 and Re. 32,572, incorporated herein by reference.

As shown in FIG. 1, at one side of the printing zone 32, a service or maintenance station 36 is provided for cleaning and maintaining the printhead 16 in an acceptable and reliable printing condition. Such cleaning and maintenance by the station 36 are normally carried out during the service and priming mode of the printer. To service or prime the printhead, the carriage 22 is first moved past at least one fixed wiper blade 38 (FIG. 2), and preferably past a pair of, but separate, such blades 38 that are mounted parallel to, and spaced from each other for contacting the nozzle face 30. As such, the printhead nozzle face 30 is wiped free of waste or residual ink, and of contaminants every time the printhead 16 enters or exits the service or maintenance station 36.

Adjacent the wiper blades 38, a fixedly mounted collection container 40 is provided for receiving the waste ink and contaminants wiped off of the nozzle face 30. In addition, the collection container 40 also receives droplets of ink intentionally ejected from the nozzles 28 in order to clear or unclog any number of such nozzles 28. To do this, the carriage 22 positions the print cartridge 20 at the collection container 40 (sometimes referred to as a spit station or spittoon), after the print cartridge has been away from the maintenance station for a specific length of time, even if it has been continually printing. This is done because during such continual printing not all nozzles will have ejected enough ink droplets in order to prevent the ink or meniscus in their nozzles from drying and becoming unacceptably viscous. With the print cartridge 20 positioned at a location confronting the collection container 40, the printer controller causes the printhead 16 to eject a number of ink droplets therein. For example, the printhead can be so caused to eject about 100 ink droplets per nozzle into the collection container. Preferably, the wiper blade or blades 38 are also located such that ink may run or drip off the blades and be collected in the collection container 40.

The collection container 40 has a surface 33 which is substantially parallel to the printhead nozzle face 30 and is oriented in a direction so that the force of gravity causes the ink to collect in the bottom thereof where an opening 42 is located for the ink to drain therethrough into a pad of absorbent material (not shown) behind the collection container. The pad of absorbent material absorbs the ink and is partially exposed to the atmosphere, so that the liquid portion of the ink absorbed therein evaporates while the solid and colorant portion of the ink along with any solid contaminants remain trapped, and accumulate therein.

When the carriage 22 continues along guide rails 24 beyond the collection container 40 for a predetermined distance, a carriage actuator edge 44 thereof contacts a catch 46 on an arm 48 of a cap member carriage 50. Cap member carriage 50 has a cap member 52 and is mounted for reciprocal movement on a guide rail 54 for translation in a direction parallel with the carriage 22 and print cartridge 20 thereon. The cap member carriage 50 is urged towards the collection container 40 by a spring 56 which surrounds guide rail 54. Cap member 52 has a closed wall 58 extending from a bottom portion 60 thereof to provide an internal recess 62 having a piece of absorbent material 64 therein. The top edge 66 of the wall 58, and preferably the outside surfaces of wall 58 including the top edge, are covered by a resilient rubber like material 68, such as, Krayton®, a product of Shell Chemical Company, having a shore A durometer 45, to form a seal.

Cap member 52 is adapted for movement from a location spaced from the plane containing the printhead nozzle face 30 to a location in which the cap seal 68 intercepts the plane containing the printhead nozzle, in response to movement by the cap member carriage 50. After the carriage actuator edge 44 contacts the catch 46, the carriage 22 and cap member carriage 50 move in unison to a capping position where the cap member 52 is sealed against the printhead nozzle face 30. In this position, the cap closed wall 58 surrounds the printhead nozzles 28. During this positioning of the cap member against the printhead nozzle face, the cap member carriage 50 is automatically locked to the print cartridge 20 by a pawl 70 in cooperation with a pawl lock edge 72 on the carriage 22. This lock by the pawl together with the actuator edge 44 in contact with catch 46 prevents excessive relative movement between the cap member 52 and the printhead nozzle face 30.

Once the printhead nozzle face is capped and the cap member is locked to the print cartridge 20, the printer controller may optionally cause the printhead 16 to eject a predetermined number of ink droplets into the cap recess 62 and absorbent material 64 therein for the purpose of increasing humidity in the sealed space of the cap recess.

A typical diaphragm vacuum pump 74 is mounted on the printer frame 11 and is operated by any known drive means, but in the preferred embodiment, the vacuum pump is operated by a printer paper feed motor 76 through motor shaft 77 when the printer is in the service and priming mode. This dual use of the motor 76 eliminates the need for a separate dedicated motor for the vacuum pump 74. The vacuum pump is connected to the cap member 52 by flexible hoses 78, 80 and by a primary ink separator 82 located intermediate the cap member 52 and vacuum pump 74. The cap member carriage guide rail 54 is fixedly positioned between fixed upstanding support members 84, 86 that extend from base 88 which is removably attached to the printer frame 11.

Figure 3:
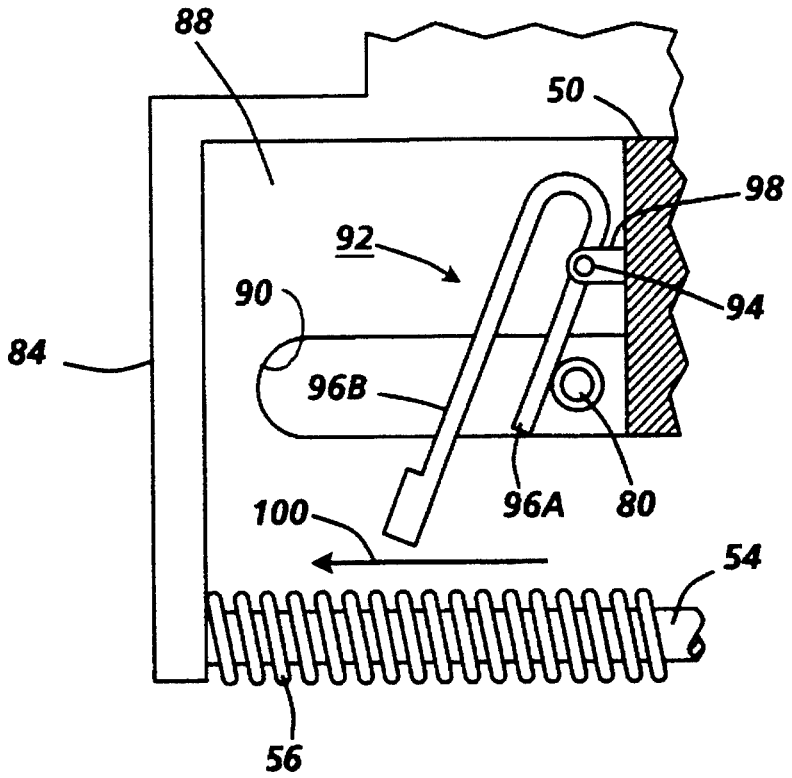
FIG. 3 is a partial cross-sectional view of the maintenance station of FIG. 2 as viewed along section line A—A (FIG. 2) showing a carriage actuated pinch valve.

Referring to FIGS. 2 and 3, base 88 has an elongated slot 90 for passage of the flexible hose 80 and for accommodating movement of the flexible hose therein. A pinch valve 92 having a U-shaped structure is rotatably attached to the cap member carriage 50 by a fixed cylindrical shaft 94 on leg 96A of the U-shaped structure. The pinch valve 92 is pivoted in flanges 98, so that movement of the cap member carriage 50 toward upstanding support member 84, as indicated by arrow 100, will eventually bring the other leg 96B of the U-shaped structure into contact with fixed support member 84, thereby pinching the flexible tube 80 closed. The pinch valve 92 is preferably of a uniform construction out of a plastic material. It is designed such that tolerances in print carriage positioning can be accommodated by deflections of pinch valve leg 96B which acts as a spring-beam.

Thus, at one predetermined location along guide rails 24 the print cartridge 20, through engagement of the carriage actuator edge 44 and catch 46 of the cap member carriage 50, causes the printhead nozzle face 30 to be capped when the tube 80 is not pinched shut. In this, the capped position, the nozzle face 30 is subjected to humidified, ambient pressure air through the cartridge vent (not shown) and vacuum pump valves 102, 104 through separator 82.

However, when it is necessary to prime the printhead, the print carriage 22 is moved from the capped position towards fixed support member 86 until leg 96B of U-shaped pinch valve 92 contacts support member 86 causing the U-shaped pinch valve to rotate, so that leg 96A of the U-shaped structure pivots against flexible hose 80 and pinches it closed, i.e., pinch valve 92 is caused to close flexible hose 80 by movement of the carriage 22. Paper feed motor 76 is energized and diaphragm vacuum pump 74 evacuates separator chamber 106, which is partially filled with an absorbent material 108, such as reticulated polyurethane foam, to a negative pressure of about minus 120 inches of $H_2O$. This negative pressure can be attained in about 10 seconds, depending on pump design and importantly on the condition of the waste ink accumulating portions of the service station 36. Meanwhile, the cap recess 62 is still at ambient pressure because of the pinch valve closure. When the desired separator negative pressure is achieved, ordinarily after about 10 seconds, the carriage 22 is returned to the location where the nozzle face 30 is capped as above, but where the flexible hose 80 is no longer pinched closed. At this point, the cap member 52 is still sealed to the printhead nozzle face 30 and the pinch valve 92 is opened thereby subjecting the sealed cap internal recess 62 and the nozzles 28 and nozzle face 30 to a negative pressure of minus 120 inches of $H_2O$.

Figure 4:
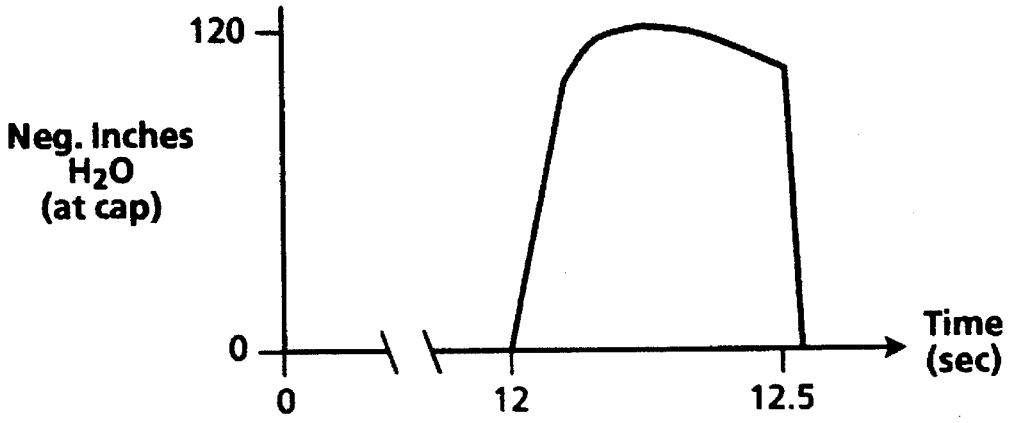
FIG. 4 is a plot of the negative pressure in the cap member of the maintenance station of FIG. 2 during a priming operation.

The print cartridge 20 remains at this priming position for about one second. This time period is determined to achieve a specific relationship of pressure in the cap member 52, and a particular flow impedance of ink through the nozzles and through the maintenance station sufficient to yield a priming target of 0.2 cc±0.05 cc of ink. The pressure curve measured while the printhead nozzle face 30 is capped during the above described priming operation is shown in FIG. 4. The pinch valve 92 pinches the flexible hose 80 closed at time zero seconds, and with the vacuum pump 74 running, causes the pressure to begin dropping in the separator 82. The cap member 52 is sealed to the printhead nozzle face 30 and no pressure is reduced in the cap member because the flexible hose 80 is pinched closed. After about 12 seconds, when the print cartridge 22 is moved in a direction back to the capping position, the cap member carriage 50 is allowed to move in a direction away from support member 86 under the urging of spring 56. At this point, the pinch valve 92 is opened and the negative pressure from the separator 82 is introduced to the cap member 52 and nozzle face 30, and ink is sucked from the nozzles 28, thus priming them. The negative pressure then begins to drop due to such flow of ink. After about one second, the carriage 22 then moves, breaking the cap seal 68 and stopping the priming action. The cap pressure then drops and returns to ambient. The print cartridge 20 is moved to a hold position between the wiper(s) 38 and the printing zone 32 for a predetermined time period, to wait while ink and air are sucked or purged from the cap member 52 to the separator 82. When this has been accomplished, the carriage 22 returns the print cartridge 20 to the capped position to await for a printing mode command from the printer controller.

While the cap member 52 is being purged of ink and the print cartridge 20 is in the hold position, the paper feed motor 76 is operating the vacuum pump 74 to pump air and ink from the cap member 52 into the separator 82 as shown by the arrows 109A, 109B, and 109C. Once in the separator, the ink is absorbed by the foam 108 which stores the ink and prevents ink from entering the pump. (Ink in the pump could damage pump valves.) Above the separator foam 108 is a chamber having a serpentine air passageway which connects inlet and outlet valves 110 and 112, and deters ink ingestion by the pump. The floor 113 of the separator 82 is made of a material that is strategically selected for its Moisture Vapor Transfer Rate (MVTR). During months of use, fluid will be lost through this migration phenomena. Any time the paper feed motor is turning for any reason other than maintenance, the print cartridge 20 must be away from the cap member 52, otherwise unwanted ink would be drawn into the cap. When the paper feed motor is turning for reasons other than maintenance, and the printer cartridge 20 is away from the cap member 52, the pump operates and continues to pump air through the maintenance station system purging ink from the cap member 52 to the separator 82. This provides some insurance that ink will not collect in flexible hose 80, thereby drying and blocking subsequent flow therethrough.

However, as it is clear from the description above of the structure and operation of the printhead service or maintenance station 36, means are provided only for the evaporation of the liquid portion of the waste ink, but not for the disposition of the solid portion of such ink or of other solid contaminants collected by maintenance station 36. As a result, the solid portion of the ink and such contaminants, e.g., paper dust, can accumulate and build up in the flexible hoses and on such other service station components as the wipers 38, the walls and absorbent materials of the collection container 40, the cap member 52 and its absorbent material 64, and the walls and absorbent materials of the ink separator 82. Such an undesirable build up or accumulation of ink solids on these components can result in poor or ineffective cleaning by the wipers, as well as in insufficient or unreliable negative pressure levels in the sealed cap member 52 after the pinch valve 92 is opened. Unclogging and priming of the nozzles which is achieved by means of such negative pressure therefore becomes unreliable, resulting in poorly maintained printheads and ultimately in poor print quality.

Figure 5:
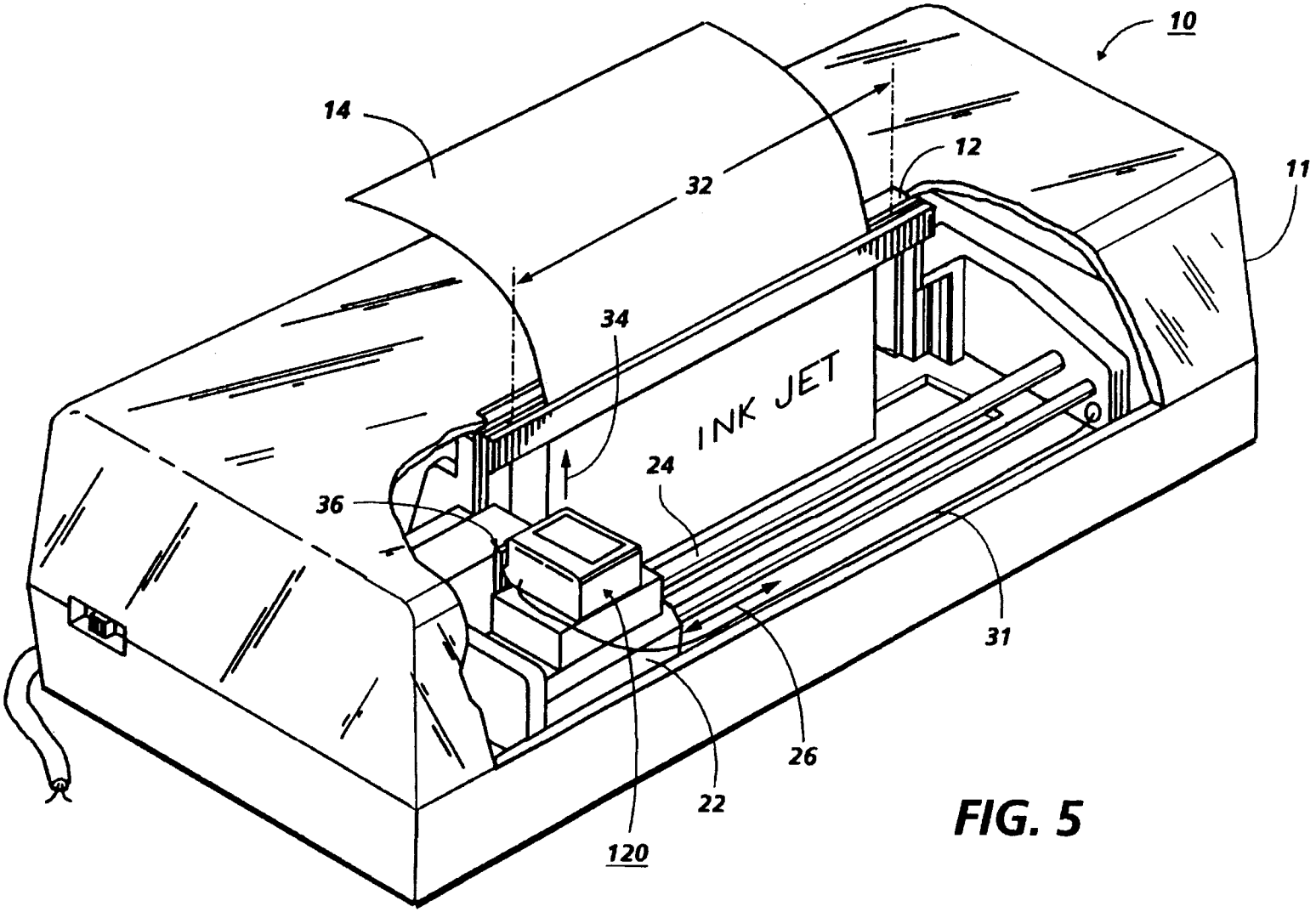
FIG. 5 is an isometric view of the thermal ink jet printer of FIG. 1 including the maintenance station cleaning apparatus of the present invention.

However, referring now to FIG. 5, according to the present invention, the printer 10 is provided with a cleaning apparatus shown generally as 120 for dissolving and removing other solids and waste ink solids that have accumulated on any of the above-mentioned components of the service or maintenance station 36.

Figure 6A:
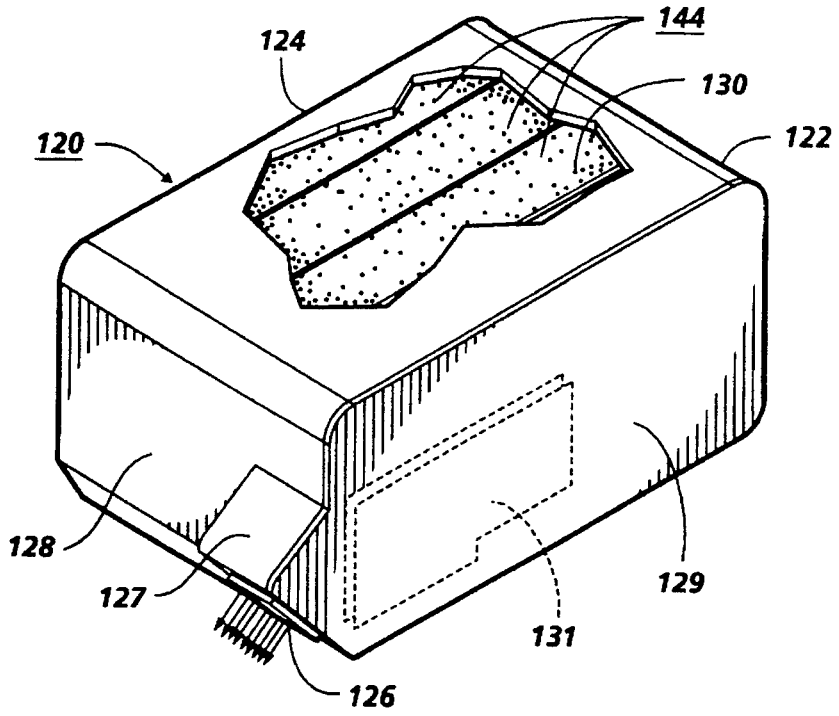
FIG. 6A and 6B are isometric views each of the cleaning apparatus of FIG. 5 showing various features thereof.
Figure 6B:
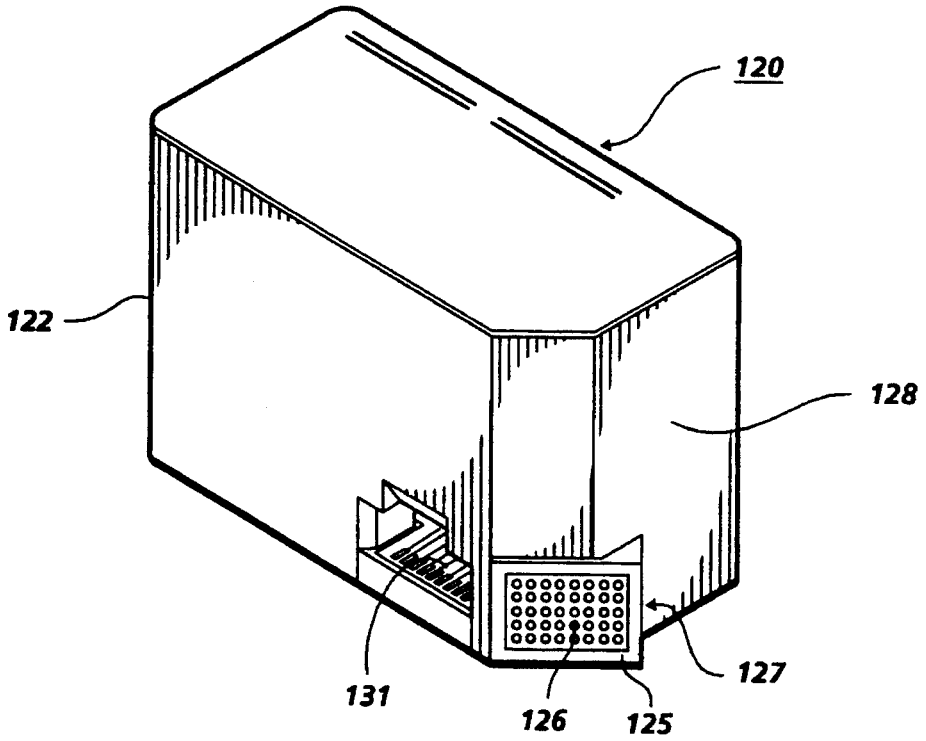
Figure 7:
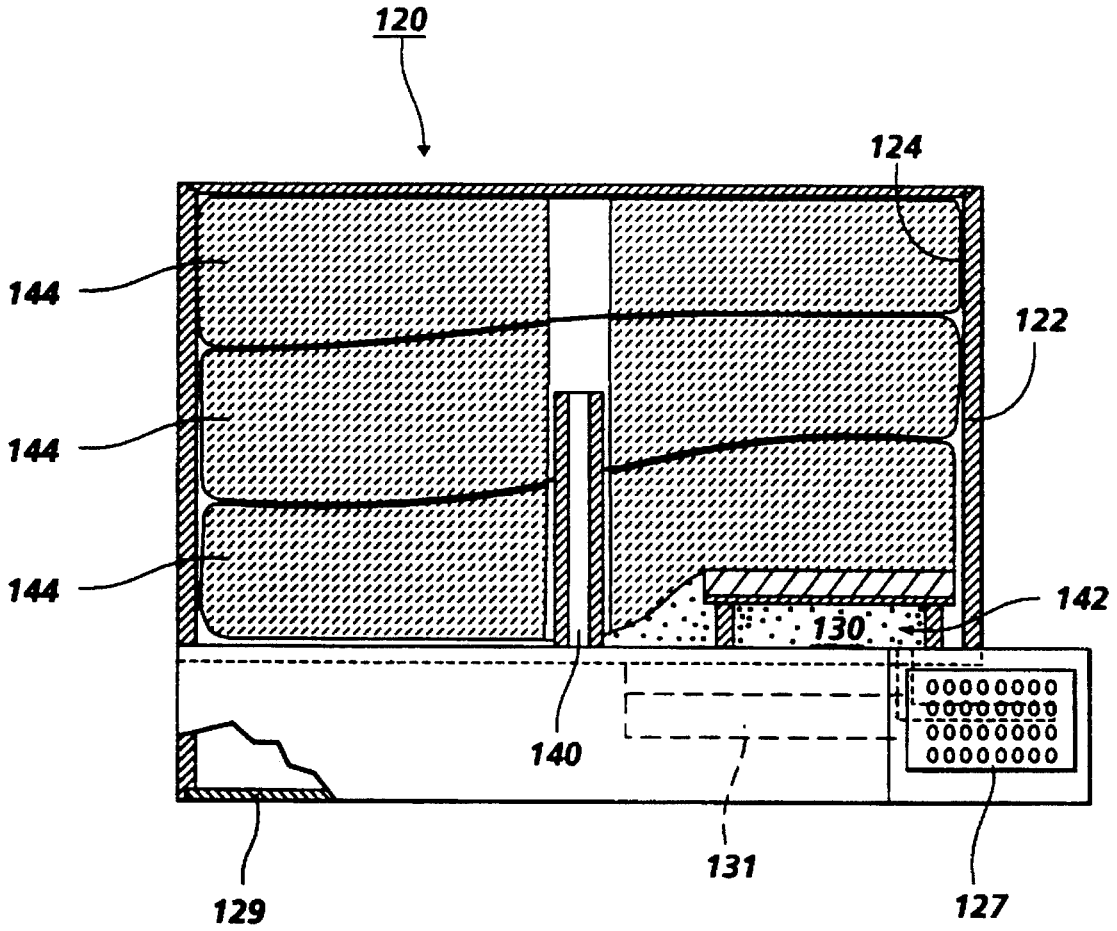
FIG. 7 is a sectional elevational view of the cleaning apparatus of FIG. 6A including storage medium therein for holding the cleaning liquid of the present invention.

As shown in FIGS. 6A, 6B and 7, the cleaning apparatus 120 of the present invention includes a housing 122 that has an overall size and shape that are substantially similar to the shape and size of a print cartridge which is usable in the ink jet printer 10. The housing 122 defines a fluid storage chamber 124, and at least one fluid output opening or aperture 126 located in a projecting nozzle portion 127 of a front wall 128 of such housing. The projecting nozzle portion 127 is similar to that in a printer-compatible print cartridge, and is suitable for capping by the service or maintenance station 36. As further shown in FIG. 6B, a plurality of the output aperture 126 is formed as a matrix through an aperture face 125 of the nozzle portion 127, and such that each aperture 126 communicates with the cleaning liquid storage chamber 124. The housing 122 typically can be made of a lightweight but durable plastic material, and may include an ultrasonically welded cover 129 as one of its walls.

As also shown in FIGS. 6A and 6B, the cleaning apparatus 120 includes an electronic interface unit 131, for example a printed wiring board, that may be bonded to one of the walls, e.g. to the cover 129, for interfacing with the host ink jet printer 10. Where the logic of the cleaning cycle of the apparatus 120 is the same as the nozzle priming logic for a printhead as described above, the interface unit 131 should be substantially the same or equivalent in value and positioning to the electronic interface unit of a printer-compatible print cartridge. Typically, such an interface unit, in a print cartridge, is bonded to a heat sink which is in turn bonded to a corresponding cover wall of the print cartridge housing.

In one preferred embodiment of the present invention, the electronic interface unit 131 of the cleaning apparatus 120 preferably is a printed wiring board having a thermistor line with a resistance value that is substantially equal to the resistance value of a corresponding interface unit in a printer-compatible print cartridge. As such, when a cleaning apparatus 120 is loaded into the host printer 10 relative to the serive or maintenance station 36 instead of a printed cartridge 20, the printer 10 would be enabled and controlled through a maintenance station cleaning cycle that is essentially equivalent to a nozzle priming cycle for a print cartridge as described above. As such, cleaning liquid (instead of ink) is sucked out of the housing 122 through the apertures 126 and into the maintenance station.

In addition to defining the chamber 124 and the apertures 126, the housing 122 as shown in FIG. 7 may also define a ventilation port 140, that is open to the atmosphere, as well as a cleaning liquid output port 142 that leads from the storage chamber 124 to the output apertures 126.

Importantly, the cleaning apparatus 120 includes a cleaning liquid 130 (FIGS. 6A and 7) that is stored in the fluid chamber 124 for ejecting through the openings or apertures 126, for example, into the recess 62 of the cap member 52 of the service or maintenance station 36. The cleaning liquid 130 advantageously includes ink-dissolving compositions for dissolving thickened or dried ink waste or residue that has accumulated on various portions of the service or maintenance station 36.

Other parts of the apparatus 120 which are useful in a practical embodiment of the invention include means for removably attaching or mounting the housing 122 to the print carriage 22 of the printer 10 such that the wall 128 and apertures 126 directly face the cap member 52 of the service or maintenance station 36. Although not absolutely necessary, the apparatus 120 may also include liquid carrying channels (not shown) linking the fluid chamber 124 and ejection apertures 126, as well as means such as electrically actuatable heat elements (not shown) for causing the cleaning liquid to be ejected in droplets in much the same manner as ink from a printhead. Ordinarily however, cleaning liquid should be ejected from the apparatus 120 under the sucking influence of negative pressure created in the cap member 52 by the vacuum pump and pinch valve arrangement of the service or maintenance station 36 as described above.

For holding the cleaning liquid 130 inside the fluid chamber 124 so that it is prevented from spilling, a storage medium material, shown as three separate portions each marked 144, may be packed into the chamber 124. The medium 144 can be in the form of a needled felt of polyester fibers, the same as is used for holding ink in ink jet printhead cartridges. Needled felt is made of fibers physically interlocked by the action of, for example, a needle loom, although in addition the fibers may be matted together by soaking or steam heating. A type of felt suitable for this purpose is manufactured by BMP of America, Medina, N.Y. Medium 144, as such, is packed inside the chamber 124 in such a manner that the felt exerts reasonable contact and compression against the inner walls of the chamber 124.

To be effective in cleaning the service station, the cleaning liquid 130, for example, should have good ink-solvent properties, and as such can be a colorless liquid consisting essentially of an ink-vehicle or base composition to which no dyes or colorants are added. As such, the cleaning liquid can be thought of as diluting any ink to a desired degree. An example of a cleaning liquid 130 consists essentially of ethylene glycol from 5% to 40%, preferably 20% by weight; isopropanol from 1% to 10%, preferably 3.5% by weight; polyethylene oxide from 0.01% to 5%, preferably 0.05% by weight; and de-ionized water as the remainder in the case of water based inks. For non-water based inks, the balance of course will be made up of the base ink-vehicle liquid for each such ink.

Furthermore, in order to improve the ink-solvency property of the cleaning liquid 130, ionic and/or non-ionic surfactants may be added to the above preferred composition. Additionally, a heavy metal chelating agent such as the tetra sodium salt of ethylene diamine tetra acetic acid (EDTA) can also be added to the composition in order to solubilize any accumulated contaminating residues consisting for example of paper dust. Such paper dust usually contains fillers such as clays, as well as calcium and magnesium carbonates which can be made soluble with the addition of the chelating agent.

According to the method of the present invention, whenever it is necessary to clean the service or maintenance station 36 of an ink jet printer, a cleaning cartridge or apparatus 120 containing the cleaning liquid 130 is mounted into the printer 10. The nozzle portion 127 of the apparatus 120 is temporarily capped and vacuum pressure is applied thereto in order to suck cleaning fluid out of the apparatus 120. As a result, those portions of the service station on which ink solids and other contaminations are likely to accumulate, are infused with the sucked out cleaning liquid 130 to dissolve such solids. The dissolved solids and residual cleaning liquid are then purged or flushed out of the service or maintenance station.

The necessity for such cleaning of the service or maintenance station may arise out of the occurrence of a prolonged non-use or non-printing period such as over a holiday period or over a weekend, or it may arise out of indications of a poor nozzle priming action. Such cleaning may also be handled on a pre-scheduled timetable in order to insure, and even extend, the useful life of the service or maintenance station. Infusing the waste-ink accumulating portions of the service station requires that a sufficient quantity of the cleaning liquid 130 be applied to and through the cap member 52 of the station into the ink separator 82.

To apply such a sufficient quantity of the cleaning liquid where the cleaning apparatus 120 is essentially a print cartridge housing filled with cleaning liquid instead of ink, any print cartridge 20 on the print carriage 22 is first removed, and the housing 122 of cleaning apparatus 120 is then mounted onto the print carriage 22 in place of the print cartridge 20. As mounted, the cleaning apparatus 120 will be across from the cap member 52 so it can be capped in the same manner as a printhead in that position—the capping position as described above. Once capped, cleaning liquid can be ejected from the housing 122 through the apertures 126 by actuating the heating elements in the liquid delivery channels of the apparatus 120. Droplets of cleaning liquid are ejected from the aperture 126 in the same manner as droplets of ink from printhead nozzles. This may be repeated a number of times if necessary in order to provide sufficient cleaning liquid for infusing portions of the service station as need be. In either case, an excess cleaning liquid collecting means, such as an auxiliary separator unit 82A may be provided in conjunction with the primary separator 82 for receiving any excess cleaning liquid that is not retained by the absorbent materials of the various portions of the service station and evaporated.

The method of the present invention as such can be practiced effectively for example using an empty, printhead 16 which is then filled with the cleaning liquid of the present invention. Because cleaning liquid can be sucked out of such the apparatus 120, the empty printhead used can be one that is rejected for otherwise being electrically non-functional.

Figure 8A:
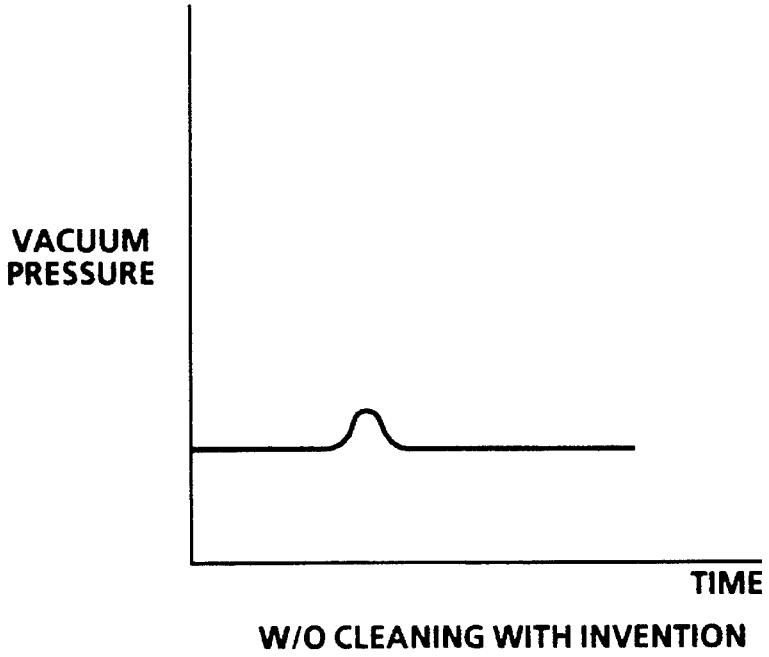
FIGS. 8A, 8B are graphs of levels of vacuum pressure on a printhead measured respectively at an uncleaned maintenance station, and at a maintenance station that had been cleaned using the method and apparatus of the present invention.
Figure 8B:
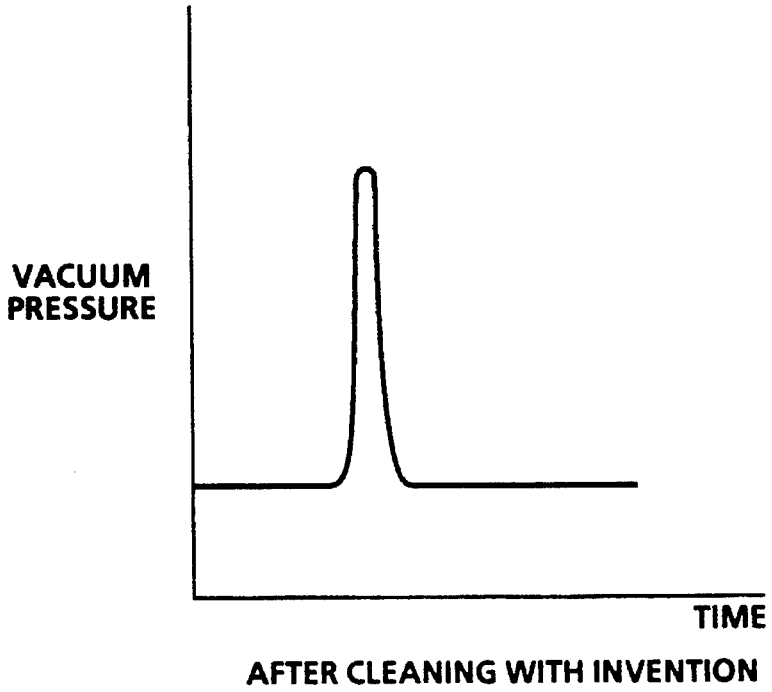

Referring now to FIGS. 8A and 8B, the results of vacuum pressure tests on waste-ink impaired service stations are plotted, and clearly show the advantage of cleaning such a station with the cleaning apparatus of the present invention. In FIG. 8A, a service station 36, which showed signs of being impaired by accumulated waste ink solids and other contaminant solids, was used as above to create a negative, nozzle-priming vacuum pressure to a printhead 16 mounted on the carriage 22. With the pinch valve 92 in the closed position, the desired level of negative pressure was established in the ink separator 82 using the vacuum pump 74. The pump was then turned off, and the pinch valve 92 opened with the cap member 52 properly sealed against and capping the printhead 16. As is illustrated, the desired level of vacuum or negative pressure in the separator was not efficiently introduced into the printhead 16 for priming its nozzles.

In FIG. 8B, however, a similarly impaired service station 36 was first cleaned using the method and apparatus of the present invention, before the negative pressure test as above was run on it. The result, as illustrated, showed a remarkable gain in the efficiency of the negative pressure of the ink separator being introduced through the service station into the printhead 16 for priming its nozzles.

As can be seen, a method and apparatus including a cleaning liquid having ink-dissolving compositions have been provided for cleaning a service or maintenance station of an ink jet printer. Cleaning such a service or maintenance prevents the otherwise gradual impairment and cleaning ineffectivenss which usually occurs as a result of the accumulating of waste ink solids and other contaminants in the service station. Cleaning such a station according to the present invention importantly assures that critical levels of negative or vacuum pressure required to prime printheads for high quality printing will always be attained over the lifetime of the service station.

What is claimed is:

1. An ink jet printer comprising:

(a) first support means for supporting a recording medium, said first support means defining a printing zone;

(b) second support means for supporting an ink-supplied printhead in printing relation with a supported recording medium;

(c) a printhead service or maintenance station located spaced from said printing zone for maintaining printheads supported on said second support means, said service or maintenance station including cleaning means for removing waste ink and other contaminants from a printhead supported on said second support means, and vacuum pressure applying means for sucking cleaning fluid from said cleaning apparatus into said service or maintenance station; and (d) a cleaning apparatus loadable on said second support means for dissolving and removing accumulated waste ink and other contaminants from said service or maintenance station, said cleaning apparatus including a cleaning fluid comprising ink dissolving compositions.

2. The ink jet printer of claim 1 wherein said cleaning apparatus is supported by said second support means.

3. The ink jet printer of claim 2 wherein said second support means is a carriage device.

4. The ink jet printer of claim 3 wherein said carriage device is movable.

5. A method of cleaning a service or maintenance station of an ink jet printer, the method comprising the steps of:

(a) mounting into the ink jet printer a cartridge cleaning apparatus having an output aperture and containing a cleaning liquid including ink dissolving compositions;

(b) temporarily capping over the output aperture and applying vacuum pressure from the service or maintenance station to the cleaning apparatus to suck out cleaning liquid therefrom;

(c) infusing portions of the service or maintenance station which collect waste ink and other contamination with the sucked-out cleaning liquid; and (d) flushing out from the service or maintenance station dissolved ink and contaminants in such cleaning liquid.

6. A cleaning apparatus for dissolving and removing accumulated waste ink and contaminants from a printhead service or maintenance station of an ink jet printer, the cleaning apparatus comprising:

(a) a housing defining a fluid storage chamber;

(b) an output aperture formed in a wall of said housing, said output aperture communicating with said storage chamber;

(c) a cleaning fluid stored in said storage chamber for ejecting through said aperture, said cleaning fluid including ink-dissolving compositions for dissolving thickened or dried ink waste and other contaminants accumulated in the service or maintenance station of the ink jet printer; and (d) an electronic interface unit connected to said housing of the cleaning apparatus for interfacing the cleaning apparatus with electronic control elements of a host ink jet printer, said electronic interface unit being substantially equivalent to that of a print cartridge usable in the host ink jet printer.

7. The cleaning apparatus of claim 6 including a storage medium packed into said fluid storage chamber for holding and preventing cleaning liquid from spilling.

8. The cleaning apparatus of claim 6 wherein said cleaning fluid is a liquid consisting essentially of a colorless ink-vehicle liquid.

9. The cleaning apparatus of claim 6 wherein a plurality of said output apertures is formed in said wall of said housing.

10. The cleaning apparatus of claim 6 wherein said cleaning fluid includes a heavy metal chelating agent includes a tetra sodium salt of ethylene diamine tetra acetic acid.

11. The cleaning apparatus of claim 8 wherein said cleaning fluid includes an ionic surfactant additive for improving dried ink solvency.

12. The cleaning apparatus of claim 8 wherein said cleaning fluid comprises about 76.45% de-ionized water on a weight basis.

13. The cleaning apparatus of claim 8 wherein said cleaning liquid comprises about 3.5% isopropanol on a weight basis.

14. The cleaning apparatus of claim 8 wherein said cleaning fluid comprises about 20% ethylene glycol on a weight basis.

15. The cleaning apparatus of claim 8 wherein said cleaning fluid comprises about 0.05% polyethylene oxide on a weight basis.

16. The cleaning apparatus of claim 8 wherein said cleaning fluid includes a non-ionic surfactant additive for improving dried and thickened ink solvency.

* * * * *